US009691525B2

(12) United States Patent
Chen

(10) Patent No.: US 9,691,525 B2
(45) Date of Patent: Jun. 27, 2017

(54) COAXIAL CABLE

(71) Applicant: FUJITSU LIMITED, Kawasaki-shi, Kanagawa (JP)

(72) Inventor: Teng-Kai Chen, Santa Clara, CA (US)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/667,425

(22) Filed: Mar. 24, 2015

(65) Prior Publication Data

US 2016/0284443 A1 Sep. 29, 2016

(51) Int. Cl.

| | |
|---|---|
| ***H01B 7/00*** | (2006.01) |
| ***H01B 11/18*** | (2006.01) |
| ***H01R 24/52*** | (2011.01) |

(52) U.S. Cl.

CPC ..... *H01B 11/1856* (2013.01); *H01R 24/525* (2013.01); *H01B 11/1895* (2013.01)

(58) Field of Classification Search

CPC ..... H01B 11/1856; H01B 13/0036; H01B 7/0216; H01B 11/1895; H01B 13/016; H01P 1/02

USPC ..... 174/86, 87, 21 CA, 88 C, 115; 333/34

See application file for complete search history.

(56) References Cited

U.S. PATENT DOCUMENTS 2,530,064 A * 11/1950 Jones ..... H01P 1/02 333/260
2,755,331 A 7/1956 Melcher et al.
2,813,144 A 11/1957 Valach et al.
2,933,714 A 4/1960 Overholser et al.
2,952,823 A 9/1960 Robinson et al.
3,432,798 A 3/1969 Brishka et al.
3,528,052 A 9/1970 Brishka et al.
3,636,239 A 1/1972 Robbins
3,665,601 A 5/1972 Dunbabin
3,731,378 A 5/1973 Toma et al.
3,836,946 A 9/1974 Geiger
3,943,470 A * 3/1976 Bingham ..... H01R 9/0521 333/260
4,128,292 A 12/1978 Mouttet
4,173,386 A 11/1979 Kauffman et al.
4,792,312 A 12/1988 Yasumoto
4,861,271 A 8/1989 Bogar et al.
4,881,912 A 11/1989 Thommen et al.
6,106,333 A 8/2000 Purdy
6,126,482 A 10/2000 Stabile
6,224,421 B1 5/2001 Maturo, Jr.
6,283,790 B1 9/2001 Idehara et al.
6,419,521 B2 * 7/2002 Kanagawa ..... H01R 13/6596 439/582
6,454,601 B1 9/2002 Vaitkus et al.
6,817,899 B1 11/2004 Zerebilov
6,860,761 B2 3/2005 Lee et al.
(Continued)

*Primary Examiner* — Steven T Sawyer
(74) *Attorney, Agent, or Firm* — Maschoff Brennan

(57) ABSTRACT

A coaxial cable is disclosed that may include an inner conductor and an outer conductor surrounding the inner conductor in a coaxial relationship. The coaxial cable may also include an insulative material located between the inner conductor and the outer conductor. A thickness of the insulative material between the inner conductor and the outer conductor may be increased in every direction at a bent portion of the coaxial cable as compared to the thickness of the insulative material between the inner conductor and the outer conductor at a non-bent portion of the coaxial cable.

15 Claims, 9 Drawing Sheets

(56) References Cited

U.S. PATENT DOCUMENTS

| | | | |
|---|---|---|---|
| 6,905,364 | B2 | 6/2005 | Swantner et al. |
| 7,025,246 | B2 | 4/2006 | Wild et al. |
| 7,273,394 | B1 | 9/2007 | English |
| 7,416,416 | B1 | 8/2008 | Hsu |
| 7,419,403 | B1 | 9/2008 | Paynter |
| 7,458,850 | B1 | 12/2008 | Burris et al. |
| 7,530,841 | B2 | 5/2009 | Henningsen |
| 8,047,872 | B2 | 11/2011 | Burris et al. |
| 8,512,047 | B2 | 8/2013 | Li |

* cited by examiner

COAXIAL CABLE

FIELD

The present disclosure relates to coaxial cables.

BACKGROUND

Data production and transmission is a common part of society. Coaxial cables are one of many common conduits for transmission of data. Coaxial cables are typically designed so that an electromagnetic field carrying communications signals exists only in the space between inner and outer coaxial conductors of the cables. The location of the electromagnetic field carrying communication signals may allow coaxial cable runs to be installed next to metal objects without the power losses that occur in other transmission lines, and may provide protection of the communication signals from external electromagnetic interference. Connectors for coaxial cables may be typically connected onto complementary interface ports to electrically integrate coaxial cables to various electronic devices and cable communication equipment. When running coaxial cables between equipment, such as between servers, the coaxial cables may bend, twist, or form other angles that may affect the electromagnetic field carrying communication signals.

The subject matter claimed herein is not limited to embodiments that solve any disadvantages or that operate only in environments such as those described above. Rather, this background is only provided to illustrate one example technology area where some embodiments described herein may be practiced.

SUMMARY

According to an aspect of an embodiment, a coaxial cable is disclosed that may include an inner conductor and an outer conductor surrounding the inner conductor in a coaxial relationship. The coaxial cable may also include an insulative material located between the inner conductor and the outer conductor. A thickness of the insulative material between the inner conductor and the outer conductor may be increased in every direction at a bent portion of the coaxial cable as compared to the thickness of the insulative material between the inner conductor and the outer conductor at a non-bent portion of the coaxial cable.

The object and advantages of the embodiments will be realized and achieved at least by the elements, features, and combinations particularly pointed out in the claims.

It is to be understood that both the foregoing general description and the following detailed description are exemplary and explanatory and are not restrictive of the present disclosure, as claimed.

BRIEF DESCRIPTION OF THE DRAWINGS

Example embodiments will be described and explained with additional specificity and detail through the use of the accompanying drawings in which.

DESCRIPTION OF EMBODIMENTS

Some embodiments described herein relate to coaxial cables and to the characteristics of coaxial cables in a bent portion of the coaxial cable. One of the characteristics of the coaxial cables may include a thickness of insulative material between an inner and outer conductor being greater at the bent portion of the coaxial cable than at a non-bent portion of the coaxial cable. Another characteristic of the coaxial cables may include that a thickness of the inner conductor may be reduced at the bent portion of the coaxial cable as compared to the non-bent portion of the coaxial cable.

In some embodiments, the characteristics of the coaxial cables at the bent portion of the coaxial cable may reduce one or more of impedance discontinuity, attenuation, resonance, reflection, and unwanted electromagnetic modes that may result because of the bent portion of the coaxial cable.

Embodiments of the present disclosure will be explained with reference to the accompanying drawings.

Figure 1A:
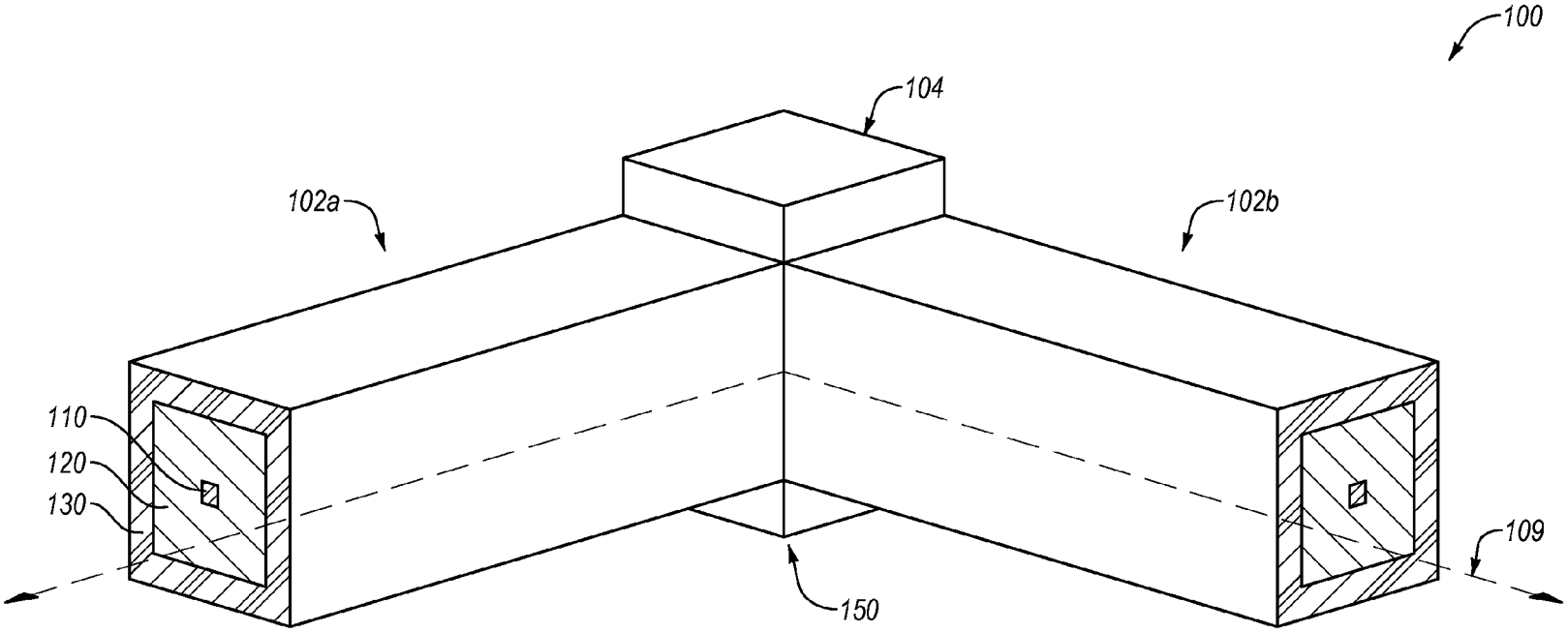
FIG. 1*a* illustrates a coaxial cable with a bend.

FIG. 1*a* illustrates a coaxial cable 100 with a bend, arranged in accordance with at least one embodiment of the present disclosure. The coaxial cable 100 may include an inner conductor 110, an insulative material 120, and an outer conductor 130. The insulative material 120 may surround and contact the inner conductor 110 in a coaxial relationship. The outer conductor 130 may surround and contact the insulative material 120 in a coaxial relationship. As a result, the outer conductor 130 may also surround the inner conductor 110 in a coaxial relationship.

The insulative material 120 may include a dielectric material. For example, the insulative material 120 may include one or more of a polymide, a carbon disulfide, a polystyrene, polytetrafluoroethylene, polyethylene, among other types of dielectric or insulative materials. The inner conductor 110 and the outer conductor 130 may include one or more conductive materials. For example, the inner conductor 110 and the outer conductor 130 may include gold, copper, silver, carbon, or some other conductive material or combination of conductive material.

The coaxial cable 100 may also include first and second non-bent portions 102*a* and 102*b* (referred to herein as the non-bent portions 102) and a bent portion 104. The bent portion 104 of the coaxial cable 100 may result when an angle other than 0 or 180 degrees is formed between the first and second non-bent portions 102*a* and 102*b* of the coaxial cable 100.

As illustrated in FIG. 1*a*, the coaxial cable 100 may generally have a square cross-sectional shape in both the bent portion 104 and the non-bent portions 102. The coaxial cable 100 may have other cross-sectional shapes as well. For example, the coaxial cable 100, the inner conductor 110, the insulative material 120, and the outer conductor 130 may have circular, quadrilateral, elliptical, polygonal, or some other cross-sectional shape.

Alternately or additionally, the bent portion 104 of the coaxial cable 100 may have a first cross-sectional shape and the non-bent portions 102 of the coaxial cable 100 may have a second cross-sectional shape. For example, the bent portion 104 may have an elliptical cross-sectional shape and the non-bent portions 102 may have a square or circular cross-sectional shape. In some embodiments, the first non-bent portion 102*a* may have a different cross-sectional shape than the second non-bent portion 102*b*.

Figure 1B:
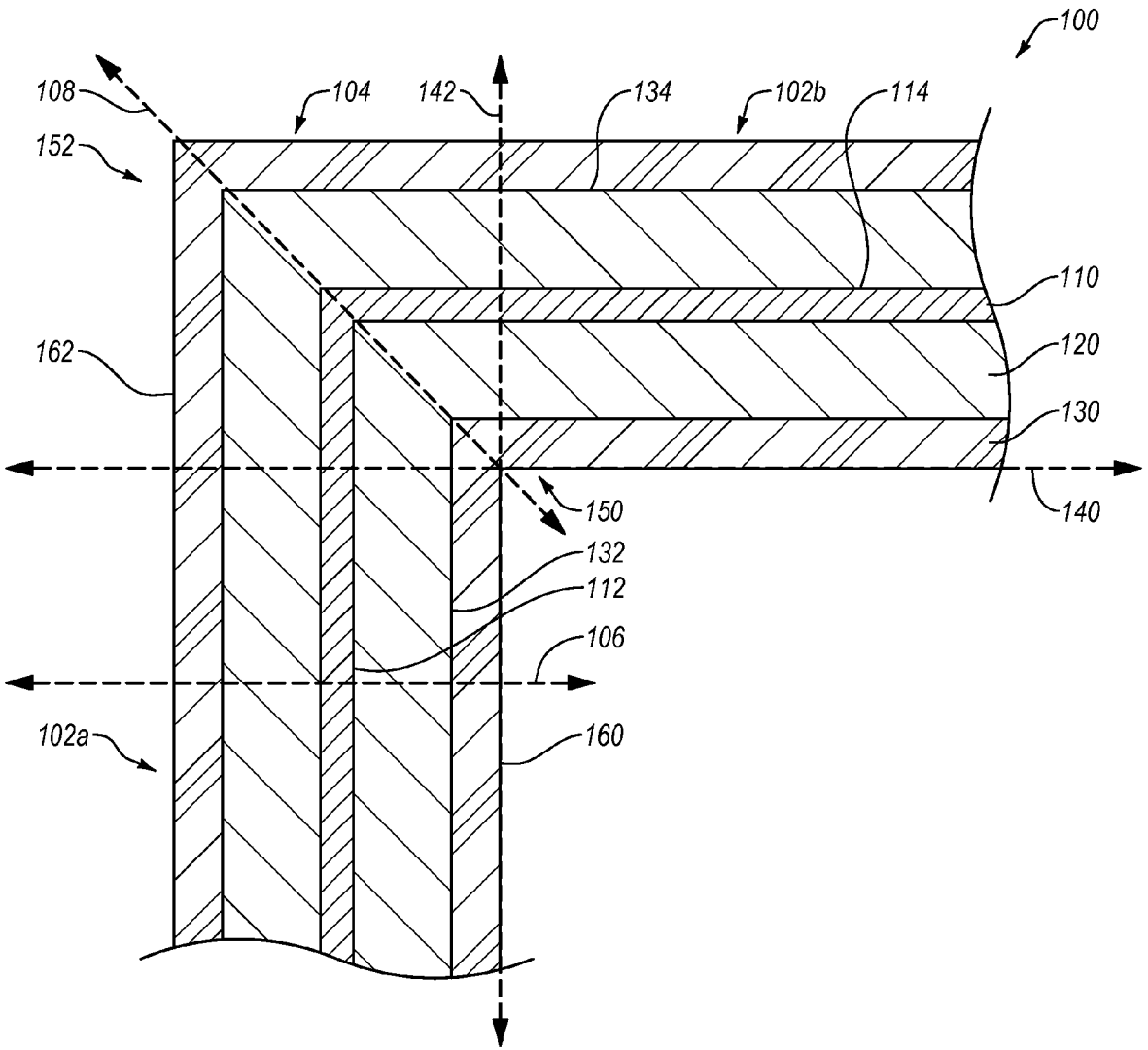
FIG. 1*b* illustrates a horizontal cross-section of the coaxial cable of FIG. 1*a;*

FIG. 1*b* illustrates a horizontal cross-section of the coaxial cable of FIG. 1*a* along the line 109. FIG. 1*b* illustrates an inner corner 150 and outer corner 152 of the bent portion 104. In these and other embodiments, the inner corner 150 of the bent portion 104 may be defined as the side of the bent portion 104 where an angle between the first and second non-bent portions 102*a* and 102*b* is less than 180 degrees. In these and other embodiments, a first outer surface 160 of the outer conductor 130 may form the inner corner 150. The outer corner 152 of the bent portion 104 may be defined as the side of the bent portion 104 where an angle between the first and second non-bent portions 102*a* and 102*b* is more than 180 degrees. In these and other embodiments, a second outer surface 162 of the outer conductor 130 may form the outer corner 152.

As illustrated, the inner corner 150 of the bent portion 104 may be defined by a 90 degree angle between the first and second non-bent portions 102*a* and 102*b*. In these and other embodiments, the bent portion 104 of the coaxial cable 100 may be distinguished from the non-bent portions 102 by first and second planes 140 and 142. The first and second planes 140 and 142 may be planes in which the first outer surface 160 of the outer conductor 130 resides.

In some embodiments, the non-bent portions 102 of the coaxial cable 100 may have a generally consistent cross-sectional shape and size. In these and other embodiments, the bent portion 104 of the coaxial cable 100 may be defined as the portion of the coaxial cable 100 that has a cross sectional shape or size different than the non-bent portions 102 of the coaxial cable due to the bend in the coaxial cable 100. In contrast, other coaxial cables may have bends, such as sweeping bends that traverse a gradual arc. In coaxial cables with sweeping bends, the cross-sectional shape and size of a bent portion may be similar to or the same as the cross sectional shape of non-bent portions. Because the bent portion 104 has a cross sectional shape different than the non-bent portions 102, in this and other embodiments, the bent portion 104 may be referred to as a non-sweeping bend.

In some embodiments, the bent portion 104 may have a cross sectional shape and/or size different than the non-bent portions 102 of the coaxial cable 100 due to the bent portion 104 being a non-sweeping bend. Alternately or additionally, the bent portion 104 may have a cross sectional shape and/or size different than a cross sectional shape and/or size of the non-bent portions 102 of the coaxial cable 100 due to an increased thickness of the insulative material 120 at the bent portion 104 that is more than an increase of thickness to accommodate a non-sweeping bend.

Figure 1D:
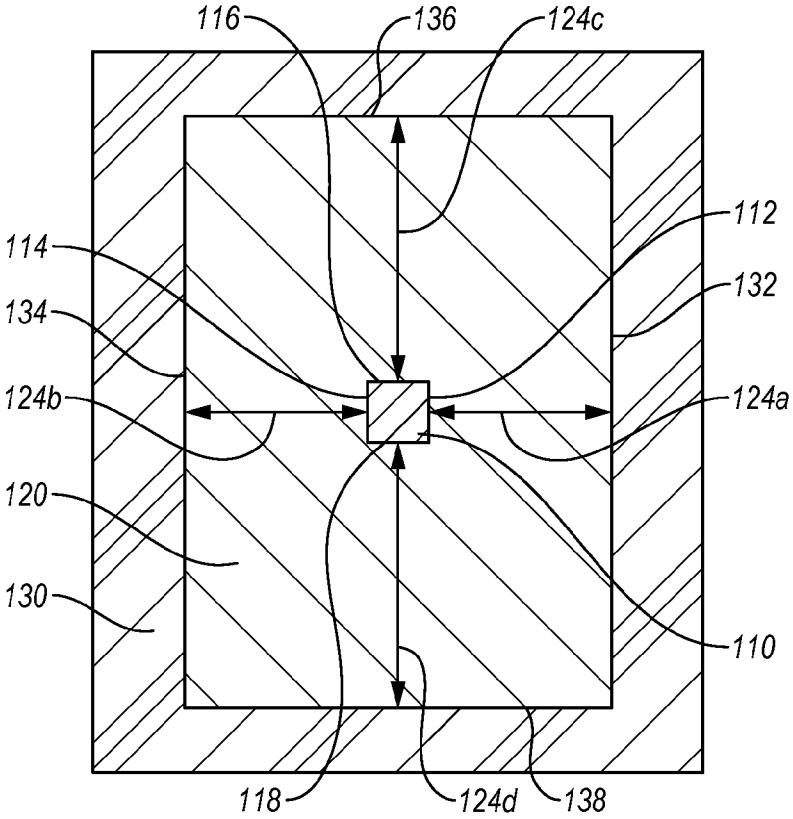
FIG. 1*d* illustrates a vertical cross-section of a bent portion of the coaxial cable of FIG. 1*a;*
Figure 1C:
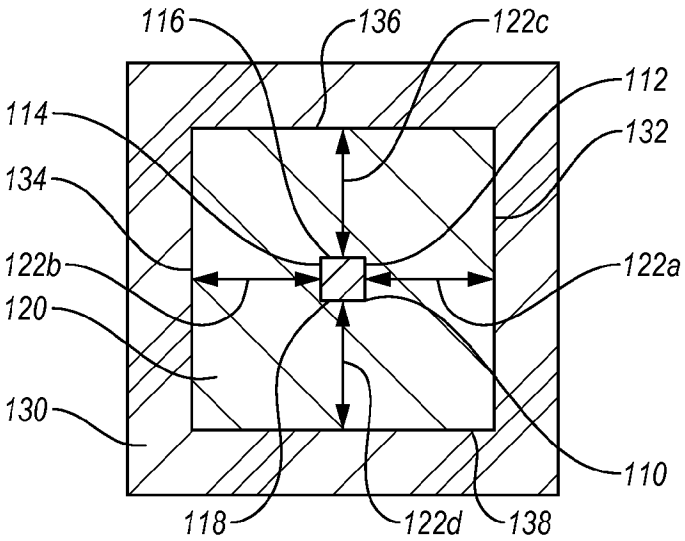
FIG. 1*c* illustrates a vertical cross-section of a non-bent portion of the coaxial cable of FIG. 1*a;*

The thickness of the insulative material 120 may be defined by a distance between an inner surface of the outer conductor 130 and an outer surface of the inner conductor 110. FIG. 1*c* illustrates a vertical cross-section of a non-bent portion of the coaxial cable of FIG. 1*b* along the line 106 that illustrates the inner surface of the outer conductor 130 and the outer surface of the inner conductor 110. In particular, FIG. 1*c* illustrates that the outer conductor 130 includes a first inner surface 132, a second inner surface 134, a third inner surface 136, and a fourth inner surface 138. FIG. 1*c* also illustrates that the inner conductor 110 includes a first outer surface 112, a second outer surface 114, a third outer surface 116, and a fourth outer surface 118.

In these and other embodiments, the first outer surface 112 and the first inner surface 132 may be corresponding surfaces. Likewise, the second outer surface 114 may correspond with the second inner surface 134, the third outer surface 116 may correspond with the third inner surface 136, and the fourth outer surface 118 may correspond with the fourth inner surface 138. In these and other embodiments, surfaces may correspond based on the surfaces being in substantially parallel planes and a distance between the surfaces being minimal. For example, the first and second outer surfaces 112 and 114 are in substantially parallel planes with the first inner surface 132. However, the first inner surface 132 corresponds with the first outer surface 112 and not with the second outer surface 114 because a distance between the first inner surface 132 and the first outer surface 112 is smaller than the distance between the first inner surface 132 and the second outer surface 114.

Referring now to FIGS. 1*a*, 1*b*, and 1*c*, the first inner surface 132 of the outer conductor 130 may be located in two different planes as a result of the bend of the coaxial cable 100. For example, the first inner surface 132 may be located in a first plane substantially parallel to the second plane 142 in the first portion non-bent 102*a*. The first inner surface 132 may also be located in a second plane substantially parallel to the first plane 140 in the second non-bent portion 102*b*. In a similar manner, the second inner surface 134 of the outer conductor 130 may also be located in two different planes as a result of the bend of the coaxial cable 100. The first and second outer surfaces 112 and 114, which correspond with the first and second inner surfaces 132 and 134, may also be located in two different planes as a result of the bend of the coaxial cable 100.

The third and fourth inner surfaces 136 and 138 may each be located substantially in a single plane even with the bend of the coaxial cable 100. The planes of the third and fourth inner surfaces 136 and 138 may also be substantially perpendicular to the first and second planes 140 and 142. In a similar manner, the third and fourth outer surfaces 116 and 118 may each be located substantially in a single plane. The planes of the third and fourth outer surfaces 116 and 118 may also be substantially perpendicular to the first and second planes 140 and 142.

A thickness of the insulative material 120, as indicated previously, may depend on a distance between the outer conductor 130 and the inner conductor 110. For example, a first non-bent thickness 122*a* of the insulative material 120 may be based on a distance between the first inner surface 132 and the first outer surface 112. Alternately or additionally, a second non-bent thickness 122*b* of the insulative material 120 may be based on a distance between the second inner surface 134 and the second outer surface 114; a third non-bent thickness 122*c* of the insulative material 120 may be based on a distance between the third inner surface 136 and the third outer surface 116; and a fourth non-bent thickness 122*d* of the insulative material 120 may be based on a distance between the fourth inner surface 138 and the fourth outer surface 118. The first non-bent thickness 122*a*, the second non-bent thickness 122*b*, the third non-bent thickness 122*c*, and the fourth non-bent thickness 122*d* may be referred here collectively as the non-bent thicknesses 122.

Because the thickness of the insulative material 120 depends on a distance between the outer conductor 130 and the inner conductor 110, when the distances between the outer conductor 130 and the inner conductor 110 vary, the thickness of the insulative material 120 may also vary. The distances between the outer conductor 130 and the inner conductor 110 may vary based on a configuration of the coaxial cable 100, such as a cross-section of the coaxial cable 100 and a bend in the coaxial cable 100.

For example, the coaxial cable 100 as illustrated includes a square cross section in the non-bent portions 102. As a result, the distances between the outer conductor 130 and the inner conductor 110 may be substantially the same or the same in the non-bent portions 102. Thus, the non-bent thicknesses 122 may be substantially the same or the same.

In the coaxial cable 100, the thickness of the insulative material 120 in the bent portion 104 may be different than the thickness of the insulative material in the non-bent portions 102. The thickness of the insulative material in the bent portion 104 is illustrated in FIG. 1*d*, which depicts a vertical cross-section of a bent portion of the coaxial cable 100 along the line 108 of FIG. 1*b*.

The bent portion 104 includes a first bent thickness 124*a* of the insulative material 120 that may be based on a distance between the first inner surface 132 and the first outer surface 112. The bent portion 104 further includes a second bent thickness 124*b* of the insulative material 120 that may be based on a distance between the second inner surface 134 and the second outer surface 114; a third bent thickness 124*c* of the insulative material 120 that may be based on distance between the third inner surface 136 and the third outer surface 116; and a fourth bent thickness 124*d* of the insulative material 120 that may be based on distance between the fourth inner surface 138 and the fourth outer surface 118. The first bent thickness 124*a*, the second bent thickness 124*b*, the third bent thickness 124*c*, and the fourth bent thickness 124*d* may be referred here collectively as the bent thicknesses 124.

In these and other embodiments, the first bent thickness 124*a* may correspond to the first non-bent thickness 122*a*, the second bent thickness 124*b* may correspond to the second non-bent thickness 122*b*, the third bent thickness 124*c* may correspond to the third non-bent thickness 122*c*, and the fourth bent thickness 124*d* may correspond to the fourth non-bent thickness 122*d*. The bent thicknesses 124 may correspond with the non-bent thicknesses 122 based on the thicknesses being determined in the same or approximately the same location along the circumference of the coaxial cable 100.

In some embodiments, at some point in the bent portion 104, each of the bent thicknesses 124 may be greater than their corresponding non-bent thicknesses 122. In some embodiments, at some point in the bent portion 104, each of the bent thicknesses 124 may be greater than the greatest non-bent thicknesses 122. Alternately or additionally, throughout the bent portion 104, each of the bent thicknesses 124 may be greater than their corresponding non-bent thicknesses 122 or greater than the greatest non-bent thicknesses 122.

In some embodiments, each of the bent thicknesses 124 may be the same or substantially the same. Alternately or additionally, each of the bent thicknesses 124 may be different or a subset of the bent thicknesses 124 may be the same and different from other of the bent thicknesses 124. For example, as illustrated in FIG. 1*d*, the first and second bent thicknesses 124*a* and 124*b*, which may be substantially the same or the same, but may be different than the third and fourth bent thicknesses 124*c* and 124*d*, which may be substantially the same or the same. In some embodiments, the third and fourth bent thicknesses 124*c* and 124*d* may be greater than the first and second bent thicknesses 124*a* and 124*b*. In some embodiments, each of the bent thicknesses 124 may vary throughout the bent portion 104. In these and other embodiments, each of the bent thicknesses 124 may vary in a similar or different manner.

In some embodiments, the bent thicknesses 124 of the insulative material 120 being greater than the non-bent thicknesses 122 of the insulative material 120 may reduce an impedance difference in the inner conductor 110 between the bent portion 104 and the non-bent portions 102. For example, the inner conductor 110 in the non-bent portions 102 may have a first impedance. In the bent portion 104, without the bent thicknesses 124 being greater than the non-bent thicknesses 122, the inner conductor 110 may have a second impedance that is lower than the first impedance due to the non-sweeping bend of the coaxial cable. To reduce the difference between the first and second impedances, the bent thicknesses 124 of the insulative material 120 may be increased. Reducing the difference between the first and second impedances may reduce attenuation, resonance, reflection, and unwanted electromagnetic modes in signals propagating along the inner conductor 110 through the bent portion 104. Reducing attenuation, resonance, reflection, and unwanted electromagnetic modes in signals propagating along the inner conductor 110 through the bent portion 104 may improve transmission of a signal through the coaxial cable 100 and may enhance high frequency performance of a signal transmitted through the coaxial cable 100.

Modifications, additions, or omissions may be made to the coaxial cable 100 without departing from the scope of the present disclosure. For example, in some embodiments, the cross-section of the coaxial cable 100 may be circular. In these and other embodiments, the surfaces discussed with respect to the coaxial cable 100 may be smaller portions of the surface of the coaxial cable 100 that may be substantially parallel and/or perpendicular to each other. Alternately or additionally, in some embodiments, the thickness of the inner conductor 110 in the bent portion 104 of the coaxial cable may be reduced. In these and other embodiments, reducing the thickness of the inner conductor 110 may result in an increase of the thickness of the insulative material 120.

Figure 2:
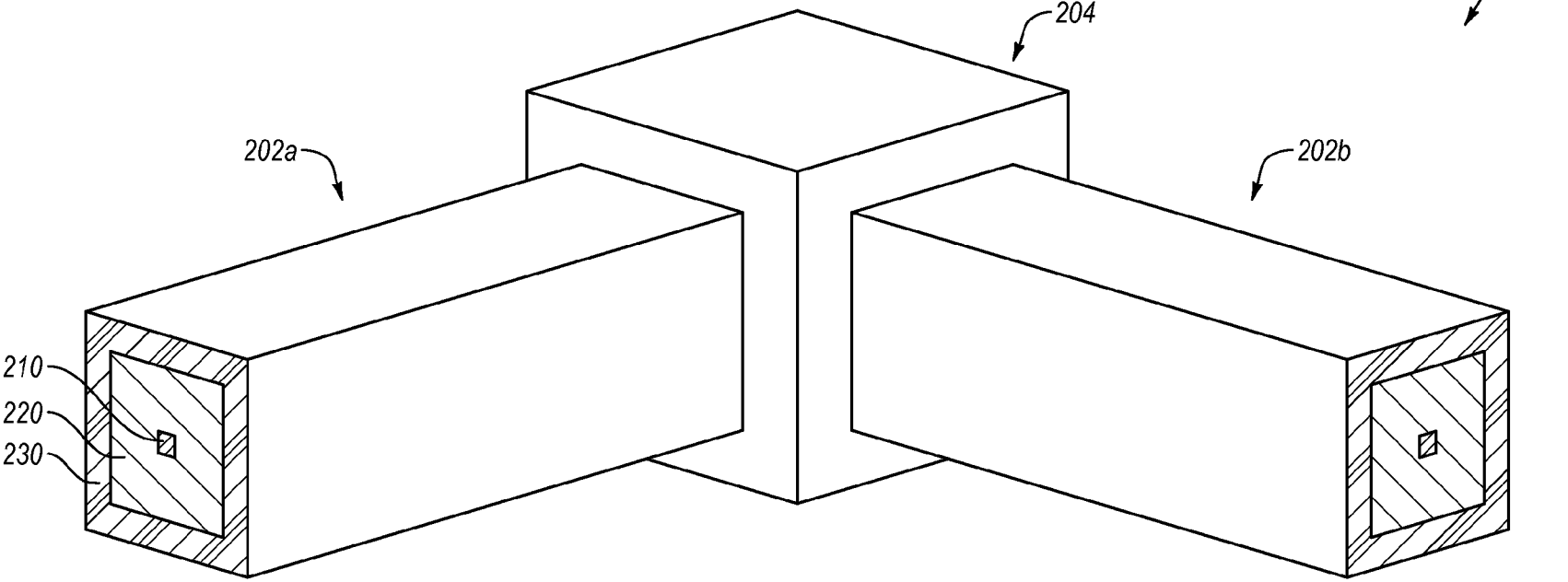
FIG. 2 illustrates another coaxial cable with a bend.

FIG. 2 illustrates another coaxial cable 200 with a bend, arranged in accordance with at least one embodiment of the present disclosure. The coaxial cable 200 may include an inner conductor 210, an insulative material 220, and an outer conductor 230. The inner conductor 210, the insulative material 220, and the outer conductor 230 may be arranged in a coaxial relationship similar to the inner conductor 110, the insulative material 120, and the outer conductor 130 of FIG. 1.

The coaxial cable 200 may include first and second non-bent portions 202*a* and 202*b* (referred to herein as the non-bent portions 202) and a bent portion 204. The bent portion 204 may be formed due to a non-sweeping bend in the coaxial cable 200. Due to the bent portion 204, an angle may be formed between the first and second non-bent portions 202*a* and 202*b*. As illustrated, the angle between the first and second non-bent portions 202*a* and 202*b* may be 90 degrees. In other embodiments, the angle between the first and second non-bent portions 202*a* and 202*b* may be a different angle.

The bent portion 204 may have larger dimensions, e.g., width, height, depth, than the dimensions of the non-bent portions 202. In some embodiments, the thickness of the inner conductor 210 and the outer conductor 230 in the bent portion 204 may be the same as the thickness of the inner conductor 210 and the outer conductor 230 in the non-bent portions 202. As a result, the thickness of the insulative material 220 in the bent portion 204 may be greater than the thickness of the insulative material 220 in the non-bent portions 202. In some embodiments, the thickness of the inner conductor 210 and the outer conductor 230 may be greater in the bent portion 204 than in the non-bent portions 202. In these and other embodiments, the thickness of the insulative material 220 in the bent portion 204 may also be greater than the thickness of the insulative material 220 in the non-bent portions 202.

Alternately or additionally, the thickness of the inner conductor 210 may be less in the bent portion 204 than in the non-bent portions 202 and the thickness of the outer conductor 230 may be the same or similar in the bent portion 204 as in the non-bent portions 202. In these and other embodiments, the thickness of the insulative material 220 in the bent portion 204 may be greater than the thickness of the insulative material 220 in the non-bent portions 202.

In some embodiments, assuming that the dimensions of the non-bent portions 202 are the same as the dimensions of the non-bent portions 102 of FIG. 1*a*, the thickness of the insulative material 220 in the bent portion 204 may be greater in every dimension than the thickness of the insulative material 120 in the bent portion 104 of FIG. 1*a*. Alternately or additionally, assuming that the dimensions of the non-bent portions 202 are the same as the dimensions of the non-bent portions 102 of FIG. 1*a*, the thickness of the insulative material 220 in the bent portion 204 may be the same thickness as the insulative material 120 in certain dimensions but greater in other dimensions as illustrated.

In some embodiments, the amount of increased thickness of the insulative material 220 at the bent portion 204 and a cross-sectional shape of the bent portion 204 may be determined based on an impedance of the non-bent portion 202 of a coaxial cable. For example, the coaxial cable 200 may have the materials, size, and/or cross-section shape selected for the inner conductor 210, the insulative material 220, and the outer conductor 230 such that the coaxial cable 200 has a particular impedance in the non-bent portions 202. For example, so that the coaxial cable 200 has a particular impedance of 50 ohms in the non-bent portions 202. In these and other embodiments, the thickness of the insulative material 220 and/or a cross-sectional shape of the coaxial cable 200 at the bent portion 204 may be adjusted to reduce an impedance difference between the bent portion 204 and the non-bent portions 202.

Modifications, additions, or omissions may be made to the coaxial cable 200 without departing from the scope of the present disclosure. For example, in some embodiments, the coaxial cable 200 may have a different cross-sectional shape in the non-bent portions 202 or the bent portion 204. Alternately or additionally, the thickness of the insulative material 220 may vary throughout the bent portion 204.

Figure 3:
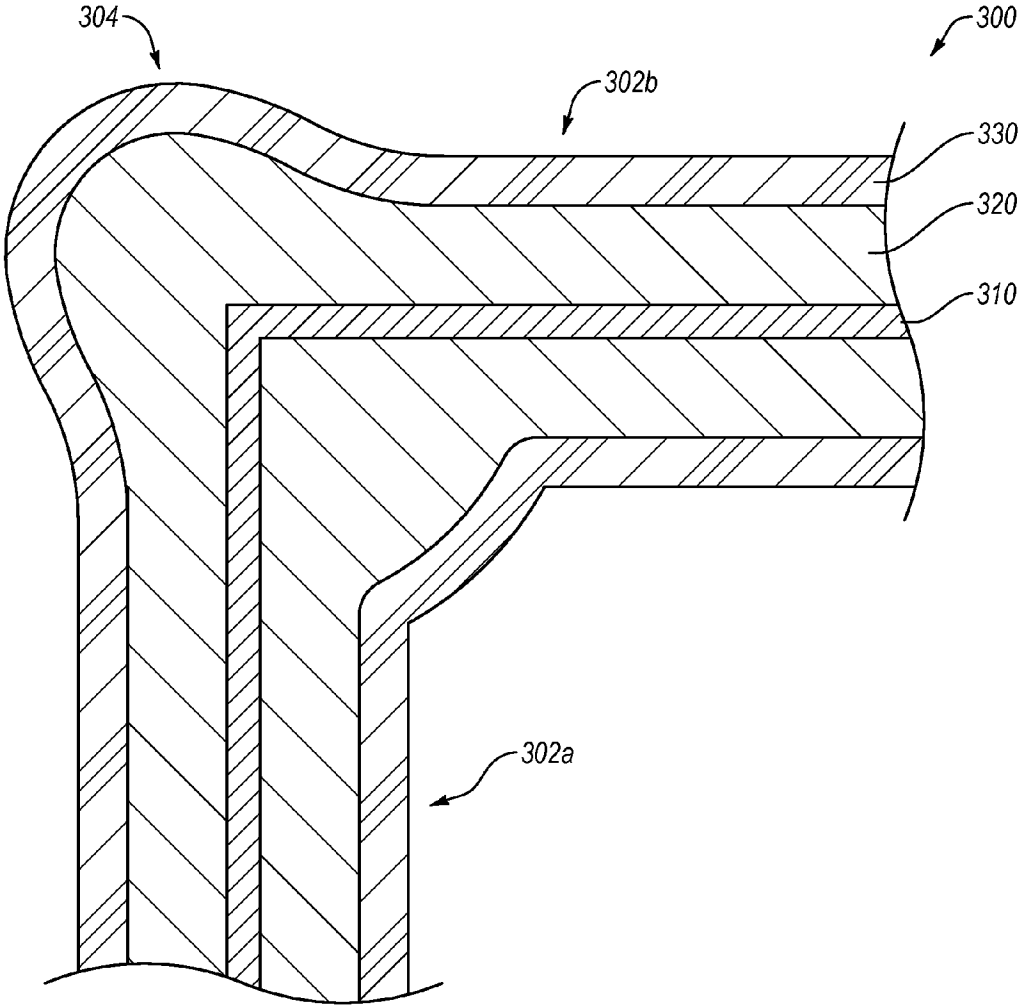
FIG. 3 illustrates a horizontal cross-section of another coaxial cable with a bend.

FIG. 3 illustrates a horizontal cross-section of another coaxial cable 300 with a bend, arranged in accordance with at least one embodiment of the present disclosure. The coaxial cable 300 may include an inner conductor 310, an insulative material 320, and an outer conductor 330 arranged in a coaxial relationship. The coaxial cable 300 may also include first and second non-bent portions 302*a* and 302*b* (referred to herein as the non-bent portions 302) and a bent portion 304. The coaxial cable 300 may have a circular cross-sectional shape in the non-bent portions 302 and a parabolic type cross-sectional shape in the bent portions 304. As illustrated, the thickness of the insulative material 320 between the inner conductor 310 and the outer conductor 330 may be greater in the bent portion 304 than in the non-bent portion 302. Furthermore, the thickness of the insulative material 320 between the inner conductor 310 and the outer conductor 330 in the bent portion 304 may vary. Modifications, additions, or omissions may be made to the coaxial cable 300 without departing from the scope of the present disclosure.

Figure 4:
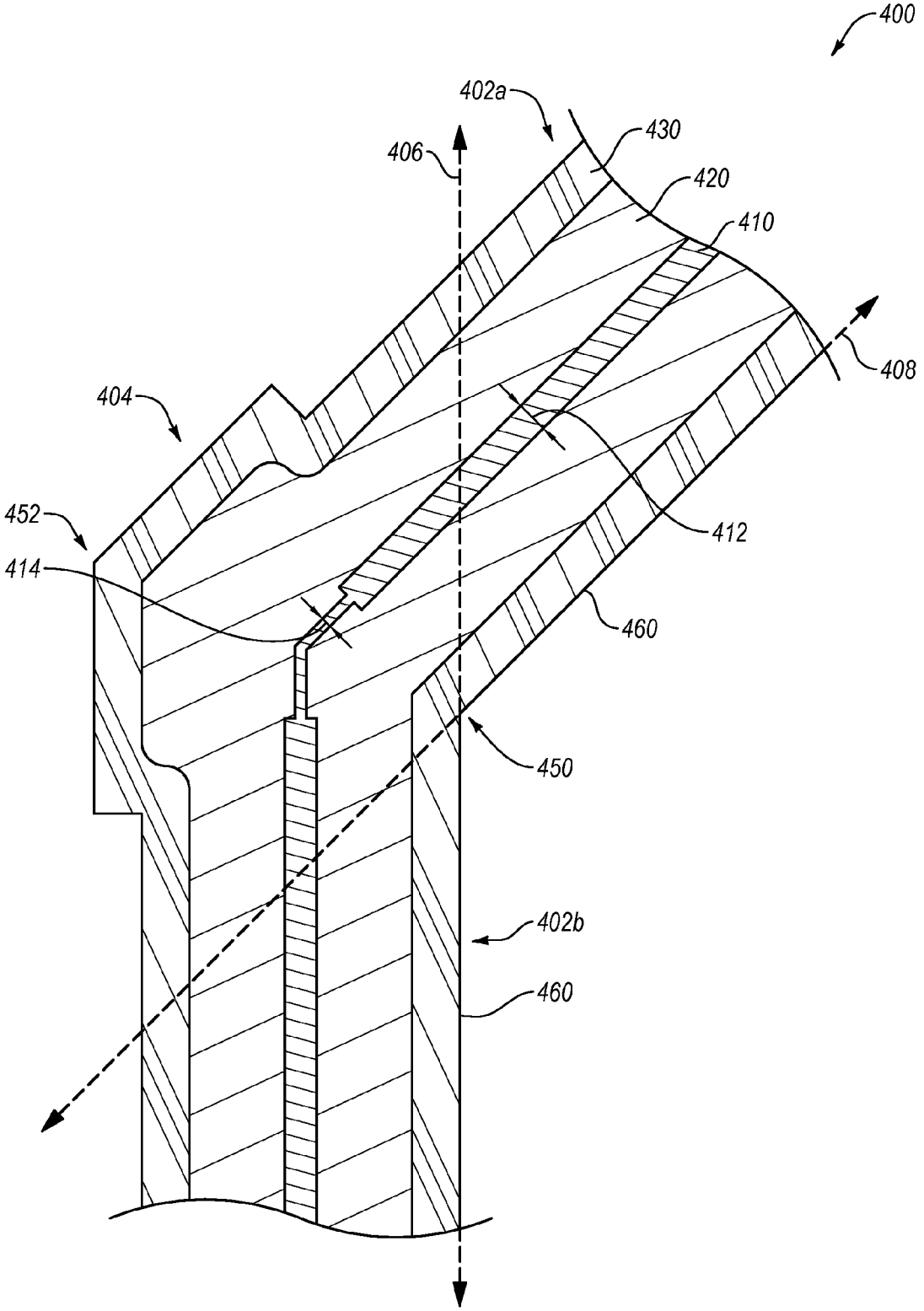
FIG. 4 illustrates a horizontal cross-section of another coaxial cable with a bend.

FIG. 4 illustrates a horizontal cross-section of another coaxial cable 400 with a bend, arranged in accordance with at least one embodiment of the present disclosure. The coaxial cable 400 may include an inner conductor 410, an insulative material 420, and an outer conductor 430. The insulative material 420 may surround and contact the inner conductor 410 in a coaxial relationship. The outer conductor 430 may surround and contact the insulative material 420 in a coaxial relationship.

The coaxial cable 400 may also include first and second non-bent portions 402*a* and 402*b* (referred to herein as the non-bent portions 402) and a bent portion 404. The bent portion 404 of the coaxial cable 400 may result from a bend in the coaxial cable that results in an inner corner 450 and an outer corner 452. As illustrated, the inner corner 450 of the bent portion 404 may be defined by a 135 degree angle between the first and second non-bent portions 402*a* and 402*b*. In these and other embodiments, the bent portion 404 of the coaxial cable 400 may be distinguished from the non-bent portions 402 by first and second planes 406 and 408. The first and second planes 406 and 408 may be planes in which a first outer surface 460 of non-bent portions 402 of the coaxial cable 400 resides.

As illustrated, the bent portion 404 of the coaxial cable 400 may have a varying cross-sectional shape that is different from the cross-sectional shape of the non-bent portions 402 of the coaxial cable 400. As a result of the varying cross-sectional shape of the bent portion 404, a thickness of the insulative material 420 between the inner conductor 410 and the outer conductor 430 in a portion of the bent portion 404 may be greater than a thickness of the insulative material 420 between the inner conductor 410 and the outer conductor 430 in the non-bent portions 402.

FIG. 4 further illustrates that the width of the inner conductor 410 may be smaller in at least a portion of the bent portion 404 than the width of the inner conductor 410 in the non-bent portions 402. For example, the inner conductor 410 may have first width 412 in the non-bent portions 402 and a second width 414 in at least a portion of the bent portion 404. In these and other embodiments, the first width 412 may be greater than the second width 414.

In some embodiments, the width of the inner conductor 410 being reduced in the bent portion 404 may reduce an impedance difference in the inner conductor 410 between the bent portion 404 and the non-bent portions 402. For example, the inner conductor 410 in the non-bent portions 402 may have a first impedance. In the bent portion 404 without the reduced width of the inner conductor 410, the inner conductor 410 may have a second impedance that is lower than the first impedance due to the non-sweeping bend of the coaxial cable. To reduce the different between the first and second impedances, the width of the inner conductor 410 may be reduced. Reducing the difference between the first and second impedances may reduce attenuation, resonance, reflection, and unwanted electromagnetic modes in signals propagating along the inner conductor 410 through the bent portion 404. Reducing attenuation, resonance, reflection, and unwanted electromagnetic modes in signals propagating along the inner conductor 410 through the bent portion 404 may improve transmission of a signal through the coaxial cable 400 and may enhance high frequency performance of a signal transmitted through the coaxial cable 400.

In some embodiments, the reduction of the width of the inner conductor 410 at the bent portion 404 and a shape of the inner conductor 410 at the bent portion 404 may be determined based on an impedance of the non-bent portion 402. For example, the coaxial cable 400 may have a particular impedance in the non-bent portions 402. In these and other embodiments, the width of the inner conductor 410 at the bent portion 404 and a shape of the inner conductor 410 at the bent portion 404 may be adjusted to reduce an impedance difference between the bent portion 404 and the non-bent portions 402.

Modifications, additions, or omissions may be made to the coaxial cable 400 without departing from the scope of the present disclosure. For example, in some embodiments, the width of the inner conductor 410 in the entire bent portion 404 may be smaller than the width of the inner conductor 410 in the non-bent portions 402. In some embodiments, the width of the inner conductor 410 in the bent portion 404 may taper or have one or more step downs from the first width 412 to the second width 414.

Figure 5:
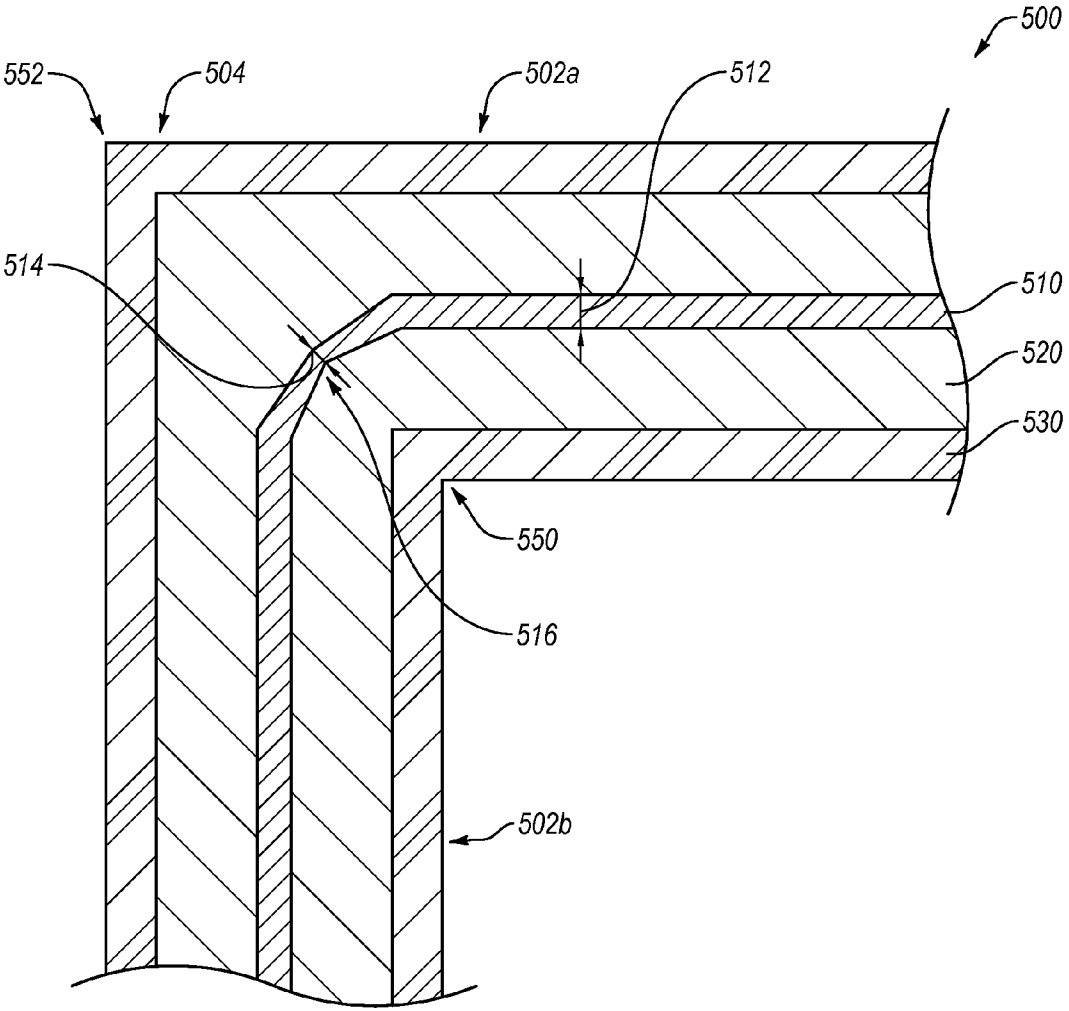
FIG. 5 illustrates a horizontal cross-section of another coaxial cable with a bend.

FIG. 5 illustrates a horizontal cross-section of another coaxial cable 500 with a bend, arranged in accordance with at least one embodiment of the present disclosure. The coaxial cable 500 may include an inner conductor 510, an insulative material 520, and an outer conductor 530. The insulative material 520 may surround and contact the inner conductor 510 in a coaxial relationship. The outer conductor 530 may surround and contact the insulative material 520 in a coaxial relationship.

The coaxial cable 500 may also include first and second non-bent portions 502*a* and 502*b* (referred to herein as the non-bent portions 502) and a bent portion 504. The bent portion 504 of the coaxial cable 500 may result from a bend in the coaxial cable that results in an inner corner 550 and an outer corner 552. As illustrated, the inner corner 550 of the bent portion 504 may be defined by a 90 degree angle between the first and second non-bent portions 502*a* and 502*b*.

FIG. 5 further illustrates that a width of the inner conductor 510 may be smaller in at least a portion of the bent portion 504 than the width of the inner conductor 510 in the non-bent portions 502. For example, the inner conductor 510 may have a first width 512 in the non-bent portions 502 and a second width 514 in at least a portion of the bent portion 504. In these and other embodiments, the first width 512 may be greater than the second width 514. Furthermore, the inner conductor 510 may taper in width in the bent portion 504 from the first width 512 to the second width 514.

The inner conductor 510 may further include a first inner corner 516 that includes an angle that is different than the angle of the inner corner 550 of the coaxial cable 500. As illustrated in FIG. 5, the first inner corner 516 may have an angle that is approximately 135 degrees. In other embodiments, the angle of the first inner corner 516 may be less than or greater than the 135 degrees.

In some embodiments, the width of the inner conductor 510 being reduced in the bent portion 504 may reduce an impedance difference in the inner conductor 510 between the bent portion 504 and the non-bent portions 502. Modifications, additions, or omissions may be made to the coaxial cable 500 without departing from the scope of the present disclosure.

Figure 6:
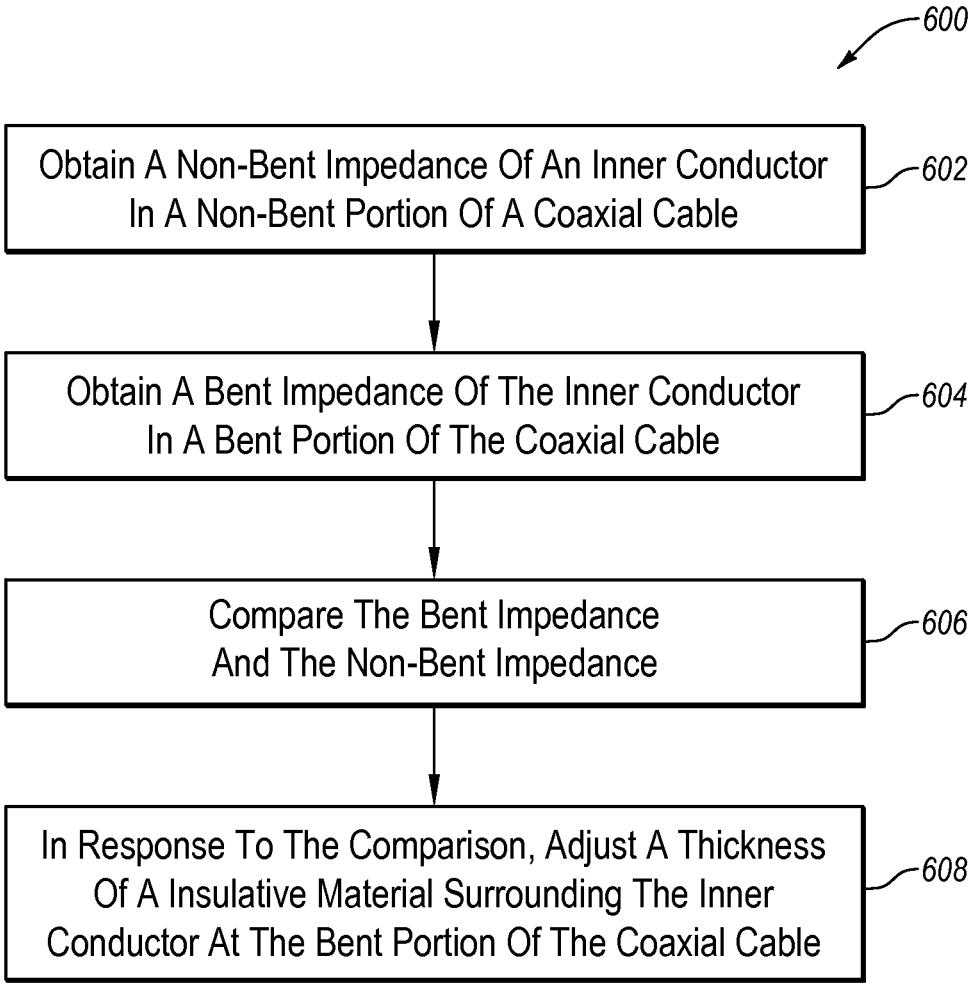
FIG. 6 is a flow chart of an example method to design a coaxial cable with a bend.

FIG. 6 is a flow chart of an example method to design a coaxial cable with a bend, which may be arranged in accordance with at least one embodiment described herein. The method 600 may be implemented, in some embodiments, by a system, such as the system 700 of FIG. 7. Although illustrated as discrete blocks, various blocks may be divided into additional blocks, combined into fewer blocks, or eliminated, depending on the desired implementation.

The method 600 may begin at block 602, where a non-bent impedance of an inner conductor in a non-bent portion of a coaxial cable may be obtained. In block 604, a bent impedance of the inner conductor in a bent portion of the coaxial cable may be obtained. In block 606, the bent impedance and the non-bent impedance may be compared.

In block 608, in response to the comparison, a thickness of an insulative material surrounding the inner conductor at the bent portion of the coaxial cable may be adjusted. In some embodiments, in response to the bent impedance being greater than the non-bent impedance, the adjusting the thickness of the insulative material may include decreasing the thickness of the insulative material. Alternately or additionally, in response to the bent impedance being less than the non-bent impedance, the adjusting the thickness of the insulative material may include increasing the thickness of the insulative material.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

For example, the method 600 may further include after the adjusting, re-comparing the bent impedance and the non-bent impedance. In these and other embodiments, the method 600 may further include, in response to the re-comparison, re-adjusting the thickness of the insulative material.

In some embodiments, the method 600 may further include, in response to the comparison, adjusting a thickness of the inner conductor. In these and other embodiments, in response to the bent impedance being greater than the non-bent impedance, the thickness of the inner conductor may be increased and the thickness of the insulative material may be decreased. In these and other embodiments, in response to the bent impedance being less than the non-bent impedance, the thickness of the inner conductor may be decreased and the thickness of the insulative material may be increased.

Figure 7:
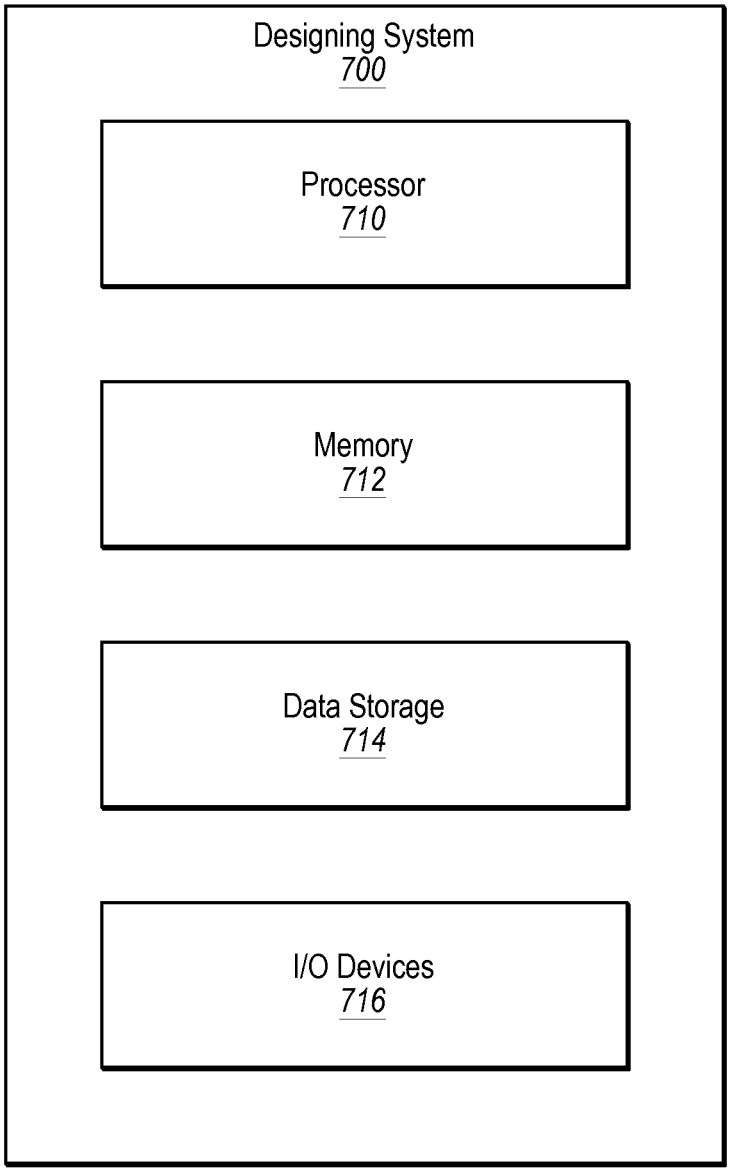
FIG. 7 illustrates a system configured to design a coaxial cable with a bend.

FIG. 7 illustrates a system 700 configured to design a coaxial cable with a bend, arranged in accordance with at least one embodiment of the present disclosure. Generally, the system 700 may include any hardware or software necessary to design a coaxial cable with a bend. In some embodiments, the system 700 may perform the method as illustrated in FIG. 6.

As illustrated in FIG. 7, the system 700 may include a processor 710, a memory 712, data storage 714, and an I/O device 716. In these and other embodiments, the processor 710, the memory 712, the data storage 714, and the I/O device 716 may be configured to perform some or all of the operations performed by the system 700. In other embodiments, the system 700 may not include one or more of the processor 710, the memory 712, the data storage 714, or the I/O device 716.

Generally, the processor 710 may include any suitable special-purpose or general-purpose computer, computing entity, or processing device including various computer hardware or software modules and may be configured to execute instructions stored on any applicable computer-readable storage media. For example, the processor 710 may include a microprocessor, a microcontroller, a digital signal processor (DSP), an application-specific integrated circuit (ASIC), a Field-Programmable Gate Array (FPGA), or any other digital or analog circuitry configured to interpret and/or to execute program instructions and/or to process data. Although illustrated as a single processor in FIG. 7, it is understood that the processor 710 may include any number of processors distributed across any number of network or physical locations that are configured to perform individually or collectively any number of operations described herein. In some embodiments, the processor 710 may interpret and/or execute program instructions and/or process data stored in the memory 712, the data storage 714, or the memory 712 and the data storage 714. In some embodiments, the processor 710 may fetch program instructions from the data storage 714 and load the program instructions in the memory 712. After the program instructions are loaded into the memory 712, the processor 710 may execute the program instructions.

The memory 712 and the data storage 714 may include computer-readable storage media or one or more computer-readable storage mediums for carrying or having computer-executable instructions or data structures stored thereon. Such computer-readable storage media may be any available media that may be accessed by a general-purpose or special-purpose computer, such as the processor 710. By way of example, and not limitation, such computer-readable storage media may include non-transitory computer-readable storage media including Random Access Memory (RAM), Read-Only Memory (ROM), Electrically Erasable Programmable Read-Only Memory (EEPROM), Compact Disc Read-Only Memory (CD-ROM) or other optical disk storage, magnetic disk storage or other magnetic storage devices, flash memory devices (e.g., solid state memory devices), or any other storage medium which may be used to carry or store desired program code in the form of computer-executable instructions or data structures and which may be accessed by a general-purpose or special-purpose computer. Combinations of the above may also be included within the scope of computer-readable storage media. Computer-executable instructions may include, for example, instructions and data configured to cause the processor 710 to perform a certain operation or group of operations.

In some embodiments, the system 700 may perform operations, such as directed by program instructions, to design a coaxial cable with a bend in a simulation environment, such as a Simulation Program with Integrated Circuit Emphasis (SPICE) or some other type or electrical circuit simulation environment. In these and other embodiments, the system 700 may perform operations to perform a simulation on parameters entered for a coaxial cable with a bend. The system 700 may perform operations to obtain a non-bent impedance of an inner conductor in a non-bent portion of a coaxial cable and a bent impedance of the inner conductor in a bent portion of the coaxial cable. The system 700 may perform operations to compare the bent impedance and the non-bent impedance. In response to the comparison, a thickness of an insulative material surrounding the inner conductor at the bent portion of the coaxial cable may be adjusted in the simulation.

After adjusting the thickness of the insulative material surrounding the inner conductor at the bent portion of the coaxial cable, the system 700 may perform operations to obtain the bent impedance of the inner conductor in the bent portion with the increased thickness. The system 700 may continue to adjust the thickness of the insulative material in the bent portion until an impedance difference between the non-bent impedance and the bent impedance reaches a particular threshold. The particular threshold may depend on a signal quality levels for future signals that may traverse the bend in the coaxial cable.

In some embodiments, in response to the bent impedance being greater than the non-bent impedance, the system 700 may decrease the thickness of the insulative material. Alternately or additionally, in response to the bent impedance being less than the non-bent impedance, the system 700 may increase the thickness of the insulative material. In some embodiments, in response to the bent impedance being greater or less than the non-bent impedance, the system 700 may adjust a shape of the insulative material. In some embodiments, the system 700 may determine the decrease, increase, and/or shape of the insulative material independently, based on user input, or using input only from a user. In these and other embodiments, the user may provide input through the I/O devices 716.

In some embodiments, the system 700 may also adjust a width, size, or shape of the inner conductor to adjust the bend impedance of the inner conductor. In these and other embodiments, in response to the bent impedance being greater than the non-bent impedance, the system 700 may increase the thickness of the inner conductor. Alternately or additionally, in response to the bent impedance being less than the non-bent impedance, the system 700 may decrease the thickness of the inner conductor.

In some embodiments, the system 700 may adjust only the width, size, or shape, of the inner conductor. Alternately or additionally, the system 700 may adjust only the thickness or shape of the insulative material at the bent portion. Alternately or additionally, the system 700 may adjust some combination of the width, size, or shape of the inner conductor and the thickness or shape of the insulative material. Modifications, additions, or omissions may be made to the system 700 without departing from the scope of the present disclosure.

While some of the system and methods described herein are generally described as being implemented in software (stored on and/or executed by general purpose hardware), specific hardware implementations or a combination of software and specific hardware implementations are also possible and contemplated. In this description, a "computing entity" may be any computing system as previously defined herein, or any module or combination of modulates running on a computing system.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description of embodiments, claims, or drawings, should be understood to contemplate the possibilities of including one of the terms, either of the terms, or both terms. For example, the phrase "A or B" should be understood to include the possibilities of "A" or "B" or "A and B."

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that various changes, substitutions, and alterations could be made hereto without departing from the spirit and scope of the present disclosure.

What is claimed is:

1. A coaxial cable, comprising:

an inner conductor that includes a first inner conductor surface and a second inner conductor surface, the second inner conductor surface is substantially perpendicular to the first inner conductor surface and the first inner conductor surface is located in two different planes as a result of a bent portion of the coaxial cable, wherein a thickness of the inner conductor at the bent portion of the coaxial cable varies;

an outer conductor surrounding the inner conductor in a coaxial relationship, the outer conductor including a first outer conductor surface that corresponds to the first inner conductor surface and a second outer conductor surface that corresponds to the second inner conductor surface; and an insulative material located between the inner conductor and the outer conductor, a thickness of the insulative material between the second inner conductor surface and the second outer conductor surface is greater at the bent portion of the coaxial cable than a non-bent portion of the coaxial cable and the thickness of the insulative material at the bent portion of the coaxial cable varies.

2. The coaxial cable of claim 1, wherein a thickness of the inner conductor at the bent portion of the coaxial cable is less than a thickness of the inner conductor at the non-bent portion.

3. The coaxial cable of claim 1, wherein the bent portion of the coaxial cable includes a corner at an approximately 90 degree angle.

4. The coaxial cable of claim 3, wherein the inner conductor has a thickness at the bent portion of the coaxial cable that is less than a thickness of the inner conductor at the non-bent portion and is positioned such that the thickness of the insulative material between the inner conductor and the outer conductor throughout the entire bent portion of the coaxial cable is larger than the thickness of the insulative material between the inner conductor and the outer conductor in the non-bent portion of the coaxial cable.

5. The coaxial cable of claim 4, wherein the insulative material and the outer conductor form an approximately 90 degree angle at the bent portion of the coaxial cable and the inner conductor forms an angle plus or minus 10 degrees from 90 degrees at the bent portion of the coaxial cable.

6. The coaxial cable of claim 1, wherein a cross-section of the coaxial cable is circular, square, quadrilateral, or elliptical.

7. A coaxial cable, comprising:

an inner conductor;

an outer conductor surrounding the inner conductor in a coaxial relationship; and an insulative material located between the inner conductor and the outer conductor, a thickness of the insulative material between the inner conductor and the outer conductor is increased in every direction at a bent portion of the coaxial cable as compared to the thickness of the insulative material between the inner conductor and the outer conductor at a non-bent portion of the coaxial cable, the thickness of the insulative material at the bent portion of the coaxial cable varies, and a thickness of the inner conductor at the bent portion of the coaxial cable varies.

8. The coaxial cable of claim 7, wherein a thickness of the inner conductor at the bent portion of the coaxial cable is less than a thickness of the inner conductor at the non-bent portion.

9. The coaxial cable of claim 7, wherein the insulative material and the outer conductor form an approximately 90 degree angle at the bent portion of the coaxial cable and the inner conductor forms an angle plus or minus 10 degrees from 90 degrees at the bent portion of the coaxial cable.

10. The coaxial cable of claim 7, wherein a cross-section of the coaxial cable is round, square, quadrilateral, or elliptical.

11. A coaxial cable, comprising:

an inner conductor that includes:

a first inner conductor surface; and a second inner conductor surface, the second inner conductor surface is substantially perpendicular to the first inner conductor surface and the first inner conductor surface is located in two different planes as a result of a bent portion of the coaxial cable, wherein a first thickness of at least a first portion of the inner conductor in the bent portion of the coaxial cable is less than a second thickness of at least a second portion of the inner conductor in a non-bent portion of the coaxial cable and the first thickness of at least the first portion of the inner conductor in the bent portion of the coaxial cable varies;

an outer conductor surrounding the inner conductor in a coaxial relationship, the outer conductor including:

a first outer conductor surface that corresponds to the first inner conductor surface and is located in a first plane and a second plane;

a second outer conductor surface that corresponds to the second inner conductor surface; and a corner defined by the bent portion of the coaxial cable, wherein the bent portion of the coaxial cable being between the first plane and the second plane and including the corner; and an insulative material located between the inner conductor and the outer conductor, a thickness of the insulative material between the second inner conductor surface and the second outer conductor surface is greater at the bent portion of the coaxial cable than the non-bent portion of the coaxial cable and the thickness of the insulative material at the bent portion of the coaxial cable varies.

12. The coaxial cable of claim 11, wherein the corner defined by the bent portion of the coaxial cable is an approximately 90 degree angle.

13. The coaxial cable of claim 11, wherein the corner defined by the bent portion of the coaxial cable is an approximately 135 degree angle.

14. The coaxial cable of claim 11, wherein the corner defined by the bent portion of the coaxial cable is defined by more than one vertex.

15. The coaxial cable of claim 11, wherein a cross-section of the coaxial cable is circular, square, quadrilateral, or elliptical.

* * * * *